United States Patent [19]

Takenouchi

[11] Patent Number: 4,954,680

[45] Date of Patent: Sep. 4, 1990

[54] HIGH FREQUENCY HEATING APPARATUS HAVING SEALABLE AND DETACHABLE MOUNTING ROCK

[75] Inventor: Shinji Takenouchi, Nagoya, Japan

[73] Assignee: Kabushiki Kaisha Toshiba, Kawasaki, Japan

[21] Appl. No.: 380,453

[22] Filed: Jul. 17, 1989

[30] Foreign Application Priority Data

Jul. 26, 1988 [JP] Japan ..... 63-184705

[51] Int. Cl.[5] ..... H05B 6/76

[52] U.S. Cl. ..... 219/10.55 E; 219/10.55 D; 219/10.55 F

[58] Field of Search ..... 219/10.55 D, 10.55 R, 219/10.55 B, 10.55 A, 10.55 E, 10.55 F; 174/35 R, 35 GC, 35 MS; 126/337 R, 337 A, 339, 333

[56] References Cited

U.S. PATENT DOCUMENTS

| | | | |
|---|---|---|---|
| 4,316,069 | 2/1982 | Fitzmayer | 219/10.55 F |
| 4,351,998 | 9/1982 | Keppel et al. | 219/10.55 R |
| 4,568,811 | 2/1986 | Yoshimura et al. | 219/10.55 D |
| 4,691,088 | 9/1987 | Gke | 219/10.55 E |

FOREIGN PATENT DOCUMENTS 62-218736 9/1987 Japan .

*Primary Examiner*—Philip H. Leung

*Attorney, Agent, or Firm*—Cushman, Darby & Cushman

[57] ABSTRACT

A housing includes a heating chamber having an opening at one end, a door for exposing/closing the opening of the heating chamber, and a portion for supplying a heating high frequency output from a bottom portion of the heating chamber to the inside thereof. A mounting rack partitions the bottom portion of the heating chamber from an upper portion thereof, and supports an object to be heated. The mounting rack has engaging portions engaged with a lower edge of the opening of the heating chamber, by which the mounting rack can pivot about the engaging portions and be detached from the lower edge, and also has recesses respectively formed on lower surfaces of the edges opposite to wall surfaces, except for the opening. A sealing member seals gaps between the wall surfaces of the heating chamber, except for the opening, and the opposite edge of the mounting rack, and has a projection fitted in a corresponding one of the recesses of the mounting rack, a base portion formed integral with the projection and brought into tight contact with each opposite edge of the mounting rack, and a tongue formed integral with the base poriton and urged against a corresponding one of the wall surfaces of the heating chamber, except for the opening.

18 Claims, 4 Drawing Sheets

HIGH FREQUENCY HEATING APPARATUS HAVING SEALABLE AND DETACHABLE MOUNTING ROCK

BACKGROUND OF THE INVENTION

1. Field of the Invention

This invention relates to a high frequency heating apparatus, such as a microwave oven, and, more particularly, to an attachment structure of a mounting rack thereof.

2. Description of the Related Art

Conventionally, a microwave oven range includes a mounting rack (hereinafter referred to as a shelf) situated at a lower portion of a housing, and on which is placed food or the like for heating, and a radiating unit, mounted on an upper portion of the housing, and which radiates microwaves downward, onto food placed on the shelf. However, because of the distance between the shelf and the radiating unit, food or the like placed on the shelf cannot always be heated uniformly.

In the conventional microwave oven, in order to uniformly heat an object to be heated, the following structure has been considered to make the distance between the microwave radiating unit and the shelf as short as possible.

More specifically, the conventional microwave oven range includes an excitation port of a waveguide serving as a microwave radiating unit and a stirrer fan in a bottom portion of a heating chamber. In the microwave oven of this type, the heating chamber is partitioned into upper and lower spaces by a food mounting shelf. The stirrer fan is arranged in the lower space partitioned by the shelf.

The shelf for supporting food is generally a flat one-piece member. Therefore, when liquid food is spilled, the spilled food may undesirably fall into the lower stirrer fan chamber through a gap between the shelf and a wall surface of the heating chamber.

In the conventional manner of solving the above problem, as shown in FIG. 10, a shelf 1 is mounted in a heating chamber 2, and a gap between the peripheral edge of the shelf 1 and a wall surface 3 of the heating chamber 2 is filled with a silicone material 4 to perform sealing. However, when this sealing system is employed, a syringe is inserted in the small heating chamber 2, and the silicone material must be injected with a visual observation along the gap. This operation is time-consuming and it is difficult to inject a uniform amount of silicone material, thus degrading operation efficiency. In addition, when a stirrer fan 5 or the like arranged in a lower space of the shelf 1 fails, the shelf 1 must be detached during maintenance service. The silicone material 4 filled in the gap cannot be easily detached, thus making it difficult to detach the shelf 1. In the worst case, parts cannot be replaced without damaging the shelf 1 or a main body 6.

As disclosed in Japanese Patent Disclosure (Kokai) No. 62-218736 (FIGS. 11 and 12), a packing 7 is mounted at a peripheral edge of a shelf 1, and the shelf 1 is fitted in a heating chamber 2 from above, so that the gap between the peripheral edge of the shelf 1 and a wall surface 3 of the heating chamber 2 is sealed by the packing 7. When routine maintenance is to be performed on this microwave oven, an upper portion of the packing 7 mounted at the peripheral edge of the shelf 1 is pressed by a finger and elastically deformed, making it easy to detach from the shelf 1, which in turn can then be easily detached.

However, since a contact surface 8 between the end face of the shelf 1 and the packing 7 is formed to be perpendicular to the surface of the shelf 1, the packing 7 is urged between the shelf 1 and the wall surface 3 of the heating chamber 2 and deformed in the X direction, as shown in FIG. 11, when the shelf 1 in the heating chamber 2 is pressed from above. As shown in FIG. 12, when the shelf 1 is pushed downward, the packing 7 becomes detached from the shelf 1, thus degrading the sealing of the shelf 1.

As described above, when the gap between the peripheral edge of the shelf 1 and the wall surface 3 of the heating chamber 2 is filled with the silicone material 4, the silicone material 4 cannot be easily detached during maintenance service. Therefore, it is difficult to easily detach the shelf 1. In order to improve the serviceability, the packing 7 may be mounted at the peripheral portion of the shelf 1 to achieve easy detachment of the packing 7. However, as described above, when this system is employed, the packing 7 is apt to be detached upon assembly.

SUMMARY OF THE INVENTION

It is therefore an object of the present invention to provide a new and improved high frequency heating apparatus having a sealable and detachable mounting rack which can improve sealing of a shelf and can facilitate assembly and disassembly of the shelf because detachment of a packing for sealing can be prevented upon assembly of the shelf, and the packing can be easily detached during maintenance service.

According to the present invention, there is provided a high frequency heating apparatus comprising:

a housing including a heating chamber having an opening at one end, a door for exposing/closing the opening of the heating chamber, and means for supplying a heating high frequency output from a bottom portion of the heating chamber to the inside of the heating chamber;

a mounting rack for partitioning the bottom portion of the heating chamber from an upper portion thereof, and for supporting an object to be heated, the mounting rack having engaging portions engaged with a lower edge of the opening of the heating chamber, by means of which the mounting rack can pivot about the engaging portions and be detached from the lower edge, and having recesses respectively formed on lower surfaces of edges opposite to wall surfaces of the heating chamber except for the opening; and sealing means for sealing gaps between the wall surfaces of the heating chamber, except for the opening, and the opposite edges of the mounting rack, the sealing means having a projection fitted in a corresponding one of the recesses of the mounting rack, a base portion formed integral with the projection and brought into tight contact with each of the opposite edges of the mounting rack, and a tongue formed integral with the base portion and urged against a corresponding one of the wall surfaces of the heating chamber except for the opening.

BRIEF DESCRIPTION OF THE DRAWINGS

These and other features of the present invention can be understood through the following embodiments by reference to the accompanying drawings, of which FIGS. 1 to 7 show a first embodiment of the present invention, of which:

FIG. 1 is a perspective view of a microwave oven range,

FIG. 2 is a side sectional view of the microwave oven range,

FIG. 3 is a front sectional view of the microwave oven range,

FIG. 4 is a developed perspective view of a shelf and a packing, and

FIGS. 5 to 7 are sectional views of a mounting portion wherein the packing is mounted to the shelf;

DETAILED DESCRIPTION OF THE PREFERRED EMBODIMENTS

Embodiments of the present invention will be described hereinafter in detail, with reference to the accompanying drawings.

Figure 1:
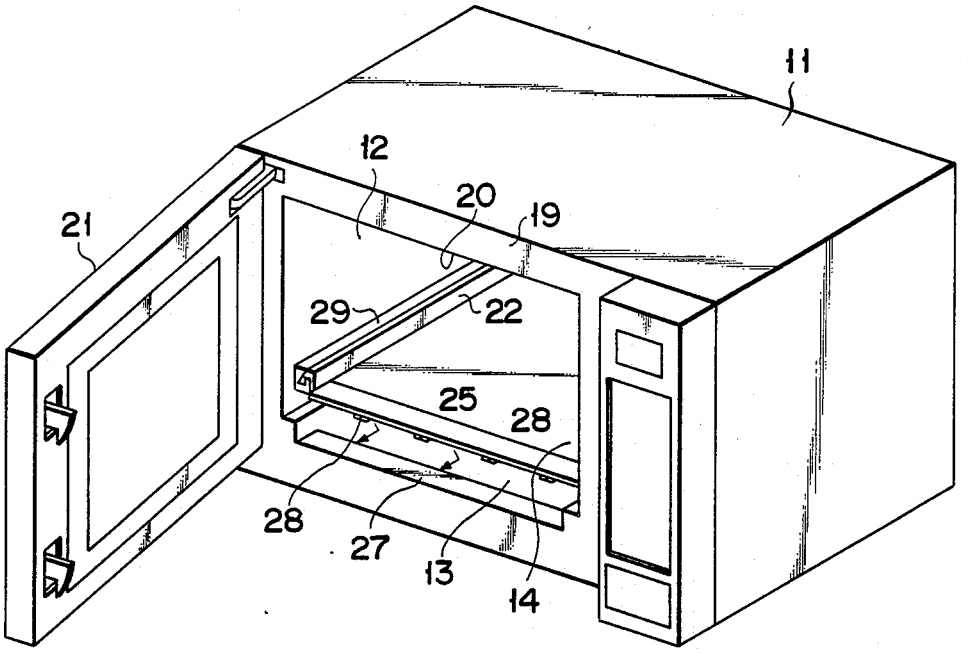
Figure 2:
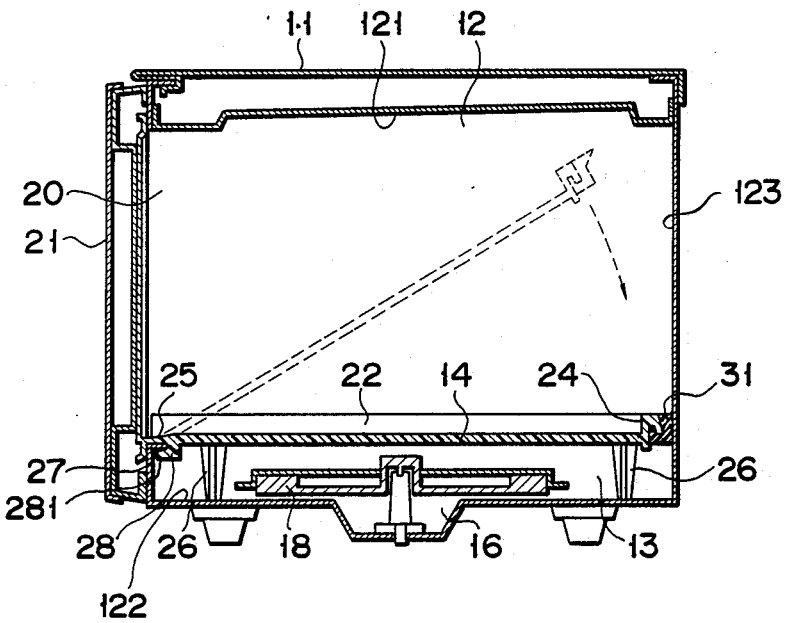
Figure 3:
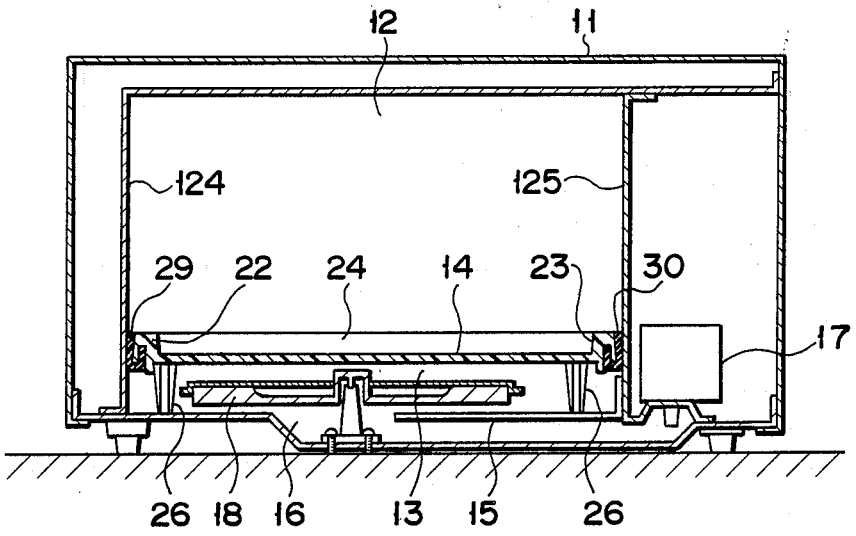

FIGS. 1 to 7 show a first embodiment of the present invention. Referring to FIG. 1, reference numeral 11 denotes a housing of a microwave oven, and numeral 12, a high frequency heating chamber formed within the housing 11. The heating chamber 12 includes a ceiling portion 121 and a bottom portion 122. An opening 20 is formed on one side of the heating chamber 12, with wall surfaces 123, 124, and 125 being formed on the remaining three sides. A shelf 14, on which an object to be heated (not shown) in the heating chamber 12 is placed, and having an area slightly smaller than the effective sectional area of the heating chamber 12, is detachably mounted in the heating chamber 12. More specifically, as is shown in FIG. 2, the (sealed-in) shelf 14 is arranged in the heating chamber 12 such that it partitions a bottom space 13 from an upper space. The shelf 14 is composed of polypropylene synthetic resin or glass fiber material which is highly heat-resistant and is substantially free from high frequency loss. As is shown in FIG. 3, an excitation port 16 of a waveguide 15 is formed in the center of a lower surface in the bottom space 13. High frequency waves oscillated by a magnetron 17 are guided through the waveguide 15, and are radiated in the heating chamber 12 via the excitation port 16. A stirrer fan 18 is arranged above the excitation port 16, and causes the high frequency waves to be radiated uniformly throughout the heating chamber 12. In addition, the opening 20 is integrally formed with a front edge 19 of the housing 11 in which the heating chamber 12 is formed. The opening 20 is closed by a door 21 pivotally supported by one end of the front edge 19.

As is shown in FIG. 2, the shelf 14 is plate-like in shape, in order for it to retain liquid food in the event that it is spilled. Specifically, upright portions 22, 23, and 24 are formed on the left and right sides, and on the rear end of the shelf 14, respectively, for this purpose. In addition, a surface 25, which is inclined downward in the forward direction, is formed at the front end of the shelf 14, and as is shown in FIGS. 2 and 3, the shelf 14 is supported above the bottom surface of the heating chamber 12 by a plurality of legs 26. Located thus, the lower surface of the front end of the shelf 14 is brought into contact with a flange 27 formed at the front edge 19 of the heating chamber 12.

A plurality of engaging portions 28, engaged with the flange 27 formed at the front edge 19 of the heating chamber 12, extend from the lower surface of the front end of the shelf 14. When the engaging portions 28 are engaged with the flange 27 of the front edge 19 by sandwiching the flange 27 with their pawls 281, the shelf 14 can be pivoted about the engaging portions 28. Note that the pawls 281 may be omitted, and the engaging portions 28 may be directly engaged with the flange 27.

Packings 29, 30, and 31 are detachably mounted to the upright portions 22, 23, and 24 which are formed at the left and right sides, and the rear end of the shelf 14, respectively. The packings 29, 30, and 31 consist of an elastic material having heat resistance and a sealing property, such as a silicone rubber material. The packings 29, 30, and 31 are elongated members formed by extrusion molding, each having a sectional shape, as represented by the packing 31 in FIG. 5. Each packing 29, 30, or 31 includes a mounting base 32, and a tongue 33 having an interference c. The tongue 33 is urged against a wall surface 34 of the heating chamber 12, and is elastically deformed to be brought into tight contact with the wall surface 34. Even if an error occurs in a sealing size $\beta$ (FIG. 7), the error is absorbed by the tongue 33. In addition, the mounting base 32 of each packing 29, 30, or 31 includes a projection 36 fitted in a recess 35 (to be described later) formed on the shelf 14 side, and a contact surface 38 inclined along an inclined surface 37 (to be described later) similarly formed on the shelf 14 side, and brought into tight contact with the inclined surface 37.

Figure 4:
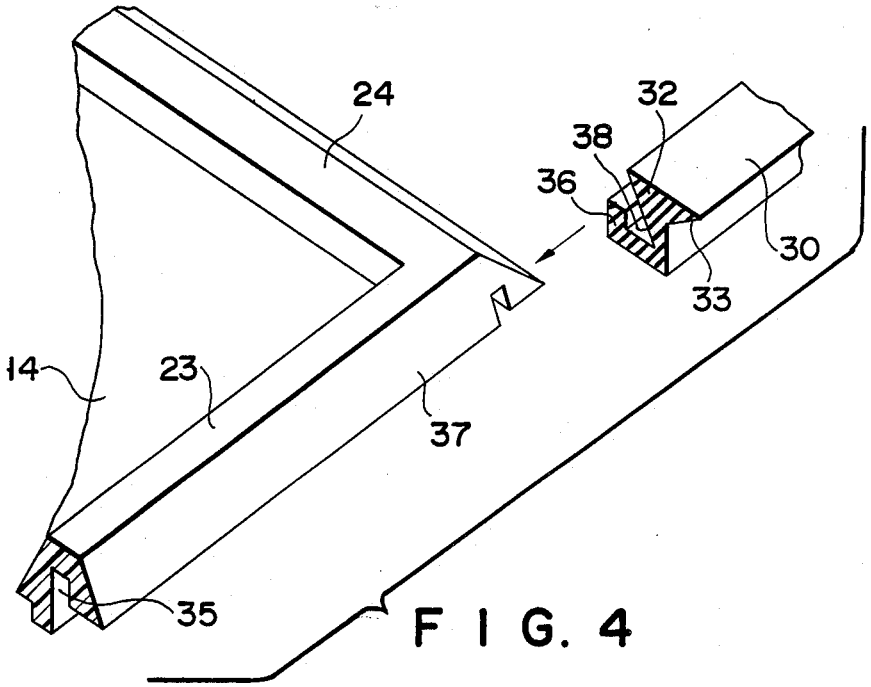
Figure 5:
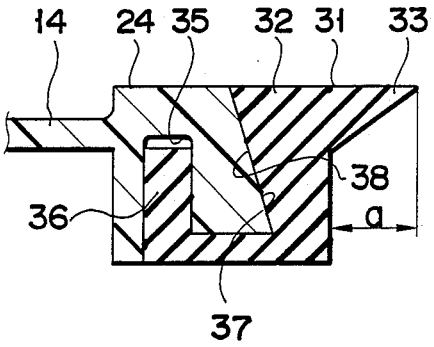
Figure 7:
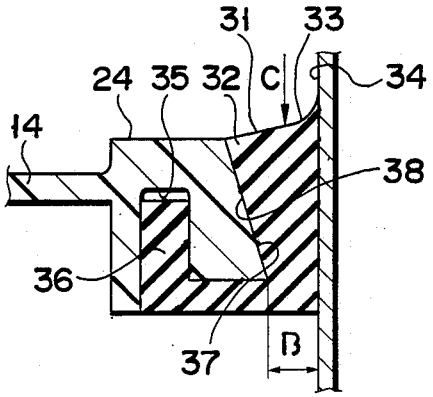

As shown in FIG. 4, the recess 35 is formed on each lower surface of the corresponding upright portion 22, 23, or 24 along the longitudinal direction. The inclined surface 37 is formed on each end face of the corresponding upright portion 22, 23, or 24 along the longitudinal direction. In this case, as shown in FIG. 7, the inclined surface 37 is inclined such that a lower contact portion is located nearer the wall surface 34 of the heating chamber 12 than an upper portion with respect to the direction perpendicular to the plate surface of the shelf 14. The mounting base 32 of each packing 29, 30, or 31 is slid and inserted from one end of the corresponding upright portion 22, 23, or 24, and the projection 36 and the contact surface 38 are fitted in the recess 35 and the inclined surface 37, respectively, as shown in FIG. 5.

Figure 6:
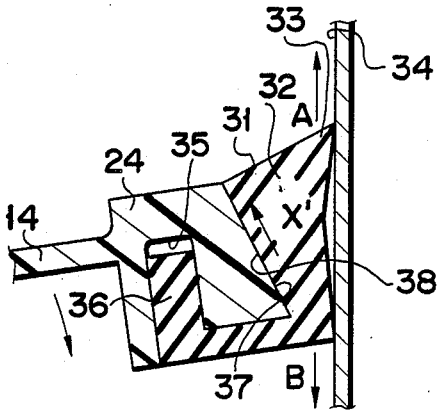

In order to mount the shelf 14 in the heating chamber 12, as indicated by a broken line in FIG. 2, the engaging portions 28 mounted at the front end of the shelf 14 are engaged with the flange 27 of the front edge 19 of the heating chamber 12, and the front end of the shelf 14 is locked. The rear end is pivoted downward about the front end toward the inside of the heating chamber 12, and the shelf 14 is inserted into the heating chamber 12. Upon insertion of the shelf 14, the tongues 33 of the packings 29, 30, and 31 are brought into tight contact with the wall surfaces 34 of the heating chamber 12, and are brought into slidable contact in the direction indicated by an arrow B while being warped in the direction indicated an arrow A, as shown in FIG. 6. At this time, the packings 29, 30, and 31 are sandwiched between the shelf 14 and the wall surfaces 34 of the heating chamber 12, and urged against the wall surfaces 34. In the packings 29, 30, and 31, forces are dispersed in the direction indicated by an arrow X' along the inclined surface 37. The surface 37 and the contact surface 38 are both inclined so that the contact area of these surfaces, i.e., friction and engaging resistance is increased, and a large force tends not to act on the projections 36 of the packings 29, 30, and 31 respectively fitted in the recesses 35 on the shelf 14 side. In this way, the packings 29, 30, and 31 cannot easily be detached from the shelf 14. More specifically, when the shelf 14 is mounted in place, this prevents the packings 29, 30, and 31 from becoming detached. As shown in FIGS. 2 and 3, when the shelf 14 is located so that the legs 26 abut against the bottom surface of the heating chamber 12, the shelf 14 is horizontally inclined. As shown in FIG. 6, the tongues 33 of the packings 29, 30, and 31 are warped in the A direction (upward), and elastically brought into tight contact with the wall surfaces 34 of the heating chamber 12, so that the gaps between the tongues 33 and the wall surfaces 34 are watertightly sealed.

Thus, even if liquid food is spilled during heating thereof, it will be retained in shelf 14, prior to external discharge via inclined surface 25, by virtue of the upright portions 22, 23, and 24 formed therearound in order to prevent overflow from the shelf sides. In addition, since the above-described packings 29, 30, and 31 are mounted on the sides (the left and right sides, and the rear end) of the shelf 14. With the tongues 33 thereof warped in the A direction (upward) and brought into tight contact with the wall surfaces 34 of the heating chamber 12, in order to seal the gap between the tongues 33 and the wall surfaces 34, this arrangement prevents an overflow of spilled liquid food from this portion to the bottom space 13 of the heating chamber 12. Therefore, since the bottom space 13 of the heating chamber 12 is protected from contamination, so too are the excitation port 16 of the waveguide 15 and the stirrer fan 18, which are arranged in this space.

When the shelf 14 is detached from the heating chamber 12, the upper portions of the packings 29, 30, and 31 are urged in the direction indicated by an arrow C (downward) in FIG. 7, and the packings are elastically deformed to decrease the thickness of their sectional areas, so that the shelf 14 is flexed downward. Then, the shelf 14 is moved upward about its front end, so that the packings 29, 30, and 31 can be easily detached downward from the shelf 14. Therefore, the shelf 14 can be easily detached during maintenance service.

Figure 8:
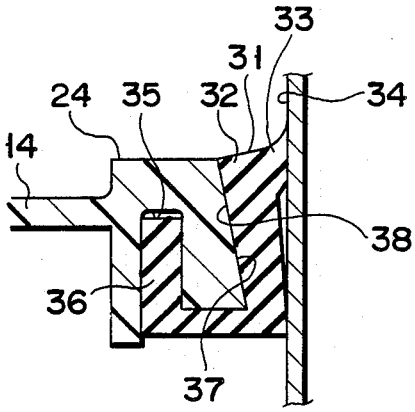
FIG. 8 is a sectional view of a mounting portion wherein a packing is mounted to a shelf according to a second embodiment of the present invention.

FIG. 8 shows a second embodiment of the present invention. In this embodiment, the thickness of a mounting base 32 of each packing 29, 30, or 31 is decreased, and a tongue 33 is brought into contact with a wall surface 34 of a heating chamber 12. With this arrangement, the friction resistance between the packings 29, 30, and 31 and the wall surfaces 34 of the heating chamber 12 is reduced, so that the packings 29, 30, and 31 cannot be further easily detached upon attachment of the shelf 14. The packings 29, 30, and 31 can be further easily detached during maintenance service.

Figure 9:
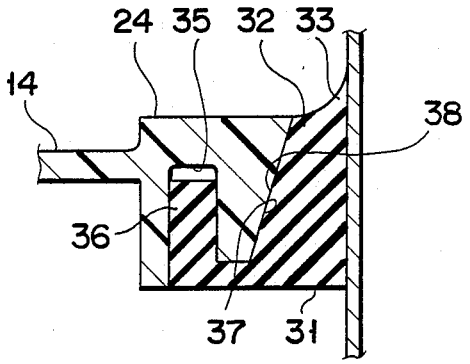
FIG. 9 is a sectional view of a mounting portion wherein a packing is mounted to a shelf according to a third embodiment of the present invention.
Figure 10:
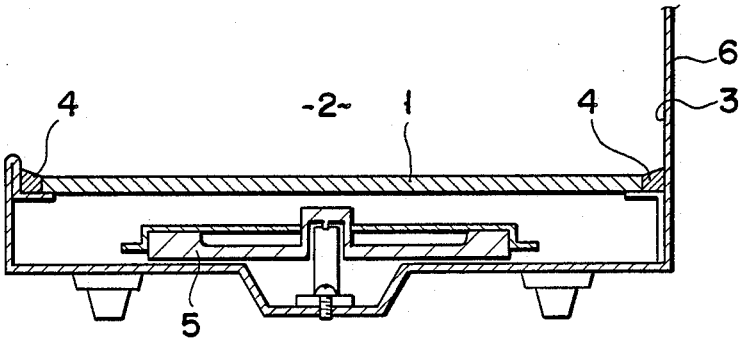
FIG. 10 (PRIOR ART)
FIG. 10 is a side sectional view of a mounting portion wherein a shelf is mounted in a heating chamber in a prior art.
Figure 11:
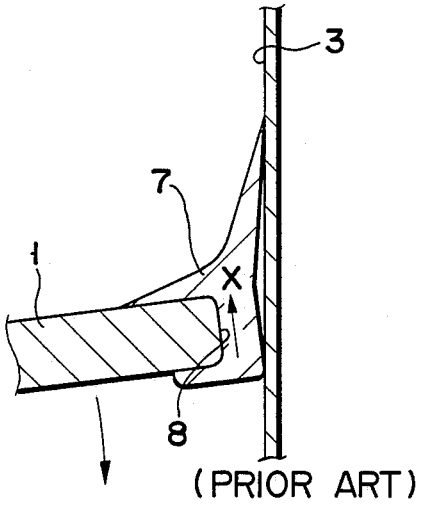
(PRIOR ART) FIG. 11
FIGS. 11 and 12 are sectional views of a mounting portion wherein a packing is mounted to a shelf in another prior art.
Figure 12:
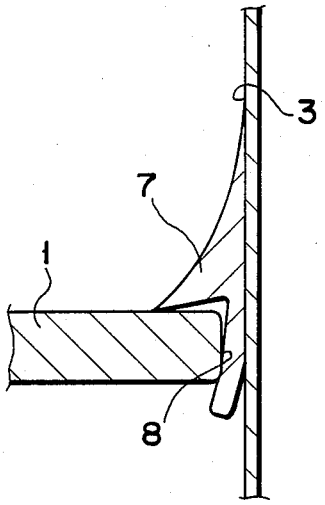
(PRIOR ART) FIG. 12

FIG. 9 shows a third embodiment of the present invention. In this embodiment, an inclined surface 37 on a shelf 14 and a contact surface 38 on a packing 31 are inclined in a direction opposite to that in the first embodiment. More specifically, the surfaces 37 and 38 are inclined such that an upper contact portion is located nearer the wall surface 34 of the heating chamber 12 than a lower portion with respect to the direction perpendicular to the surface of the shelf 14. Even if this arrangement is employed, the prescribed object of the present invention can be achieved.

Note that the present invention is not limited to the above embodiments, and various changes and modifications may be made.

As has been described in detail, according to the present invention, it is provided a high frequency heating apparatus, for supplying a high frequency wave from a bottom portion in a heating chamber to the inside of the heating chamber, the bottom portion of the heating chamber is partitioned by a shelf. The front end of the shelf is pivotally engaged with a front opening edge of the heating chamber, and the shelf is pivoted about the front end serving as a fulcrum and is mounted in the heating chamber. Packings are provided at the left and right sides, and the rear end. The packings are brought into tight contact with the wall surfaces of the heating chamber to seal the gap between the shelf and the wall surfaces of the heating chamber. The shelf includes recesses formed on the lower surfaces of the left, right, and rear edges, and inclined surfaces formed on the end faces of the left, right, and rear edges to be inclined in the direction perpendicular to a plating surface of the shelf. Each packing includes a projection fitted in the corresponding recess in the shelf, and a contact surface inclined along the inclined portion of the shelf and brought into tight contact with the inclined surface on the shelf.

With the above arrangement, when the shelf is fitted in the heating chamber by pivoting the shelf about the front end, the force exerted on each packing sandwiched between the shelf and each wall surface of the heating chamber and urged against this wall surface is dispersed along the inclined surface of the shelf. Therefore, it is difficult to exert the force on the projection of the packing fitted in the recess of the shelf. Therefore, detachment of the packings from the shelf upon its assembly can be prevented. In addition, when the upper portions of the packings are urged upward by a finger, the packings are elastically deformed. Therefore, the shelf is flexed downward, so that the shelf can be easily detached from the packings during maintenance service.

Thus, according to the present invention, there is provided a high frequency heating apparatus in which the packings can be prevented from detaching from the shelf upon assembly but can be easily detached from the shelf during routine maintenance, thereby rendering removal of the shelf from the heating chamber a simple and straight-forward process. In addition, according to the present invention, there is provided a high frequency heating apparatus which can achieve an easy assembly operation as compared with the case wherein the gap between the peripheral edge of the shield and the wall surfaces of the heating chamber is filled with the silicone material after the shelf is mounted in the heating and a. Also, the present invention facilitates a good outer appearance and a shelf arrangement in the heating chamber which is highly reliable.

What is claimed is:

1. A high frequency heating apparatus comprising:

a housing including a heating chamber having an opening at one end, a door for exposing/closing said opening of said heating chamber, and means for supplying a heating high frequency output from a bottom portion of said hearing chamber to the inside of said heating chamber;

a mounting rack for partitioning said bottom portion of said heating chamber from an upper portion thereof, and for supporting an object to be heated, said mounting rack having engaging portions engaged with a lower edge of said opening of said heating chamber, by means of which said mounting rack can pivot about said engaging portions and be detached from said lower edge, and having recesses respectively formed on lower surfaces of edges opposite to wall surfaces, except for said opening; and sealing means for sealing a gap between a wall surface of said heating chamber and an opposing edge of said mounting rack, said sealing means having a projection fitted in a corresponding one of said recesses of said mounting rack, a base portion formed integral with said projection and brought into tight contact with each of said opposite edges of said mounting rack, and a tongue formed integral with said base portion and urged against a corresponding one of the wall surfaces of said heating chamber and creating a sealed contact therewith.

2. An apparatus according to claim 1, wherein each of said opposite edges of said mounting rack has a inclined portion set in a direction perpendicular to a mounting surface of said mounting rack.

3. An apparatus according to claim 2, where said inclined portion is set such that a lower contact portion is located nearer each of said wall surfaces of said heating chamber, except for said opening, than an upper contact portion.

4. An apparatus according to claim 2, wherein said inclined portion is set such that an upper contact portion is located nearer said each of said wall surfaces of said heating chamber except for said opening than a lower contact portion.

5. An apparatus according to claim 1, wherein said base portion of said sealing means is thick relative to said gap.

6. An apparatus according to claim 1, wherein said base portion of said sealing means is thin relative to said gap.

7. An apparatus according to claim 1, wherein said sealing means is formed from a heat-resistant and elastic material for improved sealing capability.

8. An apparatus according to claim 7, wherein the material contains a silicone.

9. An apparatus according to claim 1, wherein said sealing means is formed having an elongated shape by means of extrusion molding.

10. A high frequency heating apparatus comprising:

a housing including a heating chamber having an opening at one end, a door for exposing/closing said opening of said heating chamber, and means for supplying a heating high frequency output from a predetermined portion of said heating chamber to the inside of said heating chamber;

a mounting rack for partitioning a bottom portion of said heating chamber from an upper portion thereof, and for supporting an object to be heated, said mounting rack having engaging portions engaged with a lower edge of said opening of said heating chamber, by means of which said mounting rack can pivot about said engaging portions and be detached from said lower edge, and having recesses respectively formed on lower surfaces of edges opposite to wall surfaces, except for said openings; and sealing means for sealing a gap between a wall surface of said heating chamber and an opposing edge of said mounting rack, said sealing means having a projection fitted in a corresponding one of said recesses of said mounting rack, a base portion formed integral with said projection and brought into tight contact with each of said opposite edges of said mounting rack, and a tongue formed integral with said base portion and urged against a corresponding one of the wall surfaces of said heating chamber and creating a sealed contact therewith.

11. An apparatus according to claim 10, wherein each of said opposite edges of said mounting rack has a inclined portion set in a direction perpendicular to a mounting surface of said mounting rack.

12. An apparatus according to claim 11, wherein said inclined portion is set such that a lower contact portion is located nearer said each of said wall surfaces of said heating chamber except for said opening than an upper contact portion.

13. An apparatus according to claim 11, wherein said inclined portion is set such that an upper contact portion is located nearer said each of said wall surfaces of said heating chamber except for said opening than a lower contact portion.

14. An apparatus according to claim 10, wherein said base portion of said sealing means is thick relative to said gap.

15. An apparatus according to claim 10, wherein said base portion of said sealing means is thin relative to said gap.

16. An apparatus according to claim 10, wherein said sealing means is formed from a heat-resistant and elastic material for improved sealing capability.

17. An apparatus according to claim 16, wherein the material contains silicone.

18. An apparatus according to claim 10, wherein said sealing means is formed having an elongated shape by means of extrusion molding.

* * * * *